US006935090B2

(12) United States Patent
Stolz

(10) Patent No.: US 6,935,090 B2
(45) Date of Patent: Aug. 30, 2005

(54) ROTARY-DIE-METHOD AND FILL WEDGE FOR PRODUCING CAPSULES, IN PARTICULAR SOFT CAPSULES

(75) Inventor: Leo Stolz, Ganterschwil (CH)

(73) Assignee: Swiss Caps Rechte und Lizenzen AG, Kirchberg (CH)

( * ) Notice: Subject to any disclaimer, the term of this patent is extended or adjusted under 35 U.S.C. 154(b) by 212 days.

(21) Appl. No.: 10/432,507

(22) PCT Filed: Dec. 13, 2001

(86) PCT No.: PCT/CH01/00711

§ 371 (c)(1),
(2), (4) Date: Nov. 3, 2003

(87) PCT Pub. No.: WO02/49572

PCT Pub. Date: Jun. 27, 2002

(65) Prior Publication Data

US 2004/0060258 A1 Apr. 1, 2004

(30) Foreign Application Priority Data

Dec. 20, 2000 (EP) ..... 00811211

(51) Int. Cl.[7] ..... B65B 47/06

(52) U.S. Cl. ..... 53/454; 53/433; 53/440; 53/560

(58) Field of Search ..... 53/433, 454, 560, 53/511, 440, 127

(56) References Cited

U.S. PATENT DOCUMENTS

| | | | | | |
|---|---|---|---|---|---|
| 3,269,088 | A | * | 8/1966 | Kath | 53/560 |
| 4,662,155 | A | | 5/1987 | Chasman | |
| 6,340,473 | B1 | * | 1/2002 | Tanner et al. | 424/451 |
| 6,352,717 | B2 | * | 3/2002 | Alex et al. | 424/451 |
| 6,482,516 | B1 | * | 11/2002 | Sadek et al. | 428/402.24 |

* cited by examiner

*Primary Examiner*—Rinaldi I. Rada
*Assistant Examiner*—Hemant M. Desai
(74) *Attorney, Agent, or Firm*—Nath & Associates PLLC; Gary M. Nath; Tanya E. Harkins

(57) ABSTRACT

The filling wedge (4) with its preferably concave wedge surfaces (12, 12') is provided with feed channels (5) and preferably with a heating device (13) for heating up the wedge surfaces. To prevent heat-sensitive filling material from being heated up when it is passed through the filling wedge, arranged between the feed channels and the wedge surfaces is a means reducing the heat transfer, preferably in the form of a respective cooling channel (8, 8'). Consequently, a thermal separation is achieved in the filling wedge between the feed channels and the wedge surfaces, which makes it possible to work with high operating temperatures for the capsule shell material. Such high temperatures are required, for example, in the case of capsule shells of thermoplastic starch.

17 Claims, 5 Drawing Sheets

ROTARY-DIE-METHOD AND FILL WEDGE FOR PRODUCING CAPSULES, IN PARTICULAR SOFT CAPSULES

FIELD OF THE INVENTION

The invention relates to a rotary die process for manufacturing capsules, in particular soft capsules,. The invention also relates to a filling wedge for a machine for manufacturing capsules, in particular soft capsules.

BACKGROUND OF THE INVENTION

This process with rotating forming rolls has been known and customary for many years and today represents one of the most widespread encapsulating processes for the manufacture of pharmaceutical, dietetic and technical capsules. Conventional rotary die processes are described for example in "Die Kapsel" [the capsule], Wissenschaftliche Verlagsgesellschaft MBH, Stuttgart, 1983.

A basic prerequisite for forming the capsules between the two forming rolls is to reach a sufficiently high temperature for fusing the two strips of material to form a seamless capsule. In the case of conventional gelatin capsules, the temperature of the wedge is about 43° C.+/−5° C. It is already known to arrange a heating device within the filling wedge to maintain the desired sealing temperature. The heating device may comprise heating cartridges fitted into the filling wedge or pipes for passing a liquid heating medium through, as described for example in EP-A-227 060.

These relatively high temperatures of the surface of the wedge sometimes have a harmful effect on the filling material. For instance, thermal decomposition may occur on account of the heat sensitivity of a wide variety of active substances. In the case of conventional material strips of gelatin, it is true that filling material temperatures of, for example, 25° C. to 35° C. can just about be maintained. When processing thermoplastic starch compositions, for example according to European Patent Application EP A 1 103 254, completely different temperature conditions are obtained, however. The material strips are produced by extrusion at temperatures above 100° C. and the melting point of the composition required for sealing is about 80° C. These much higher operating temperatures in the case of starch strips as opposed to gelatin strips are problematical for numerous filling materials. This applies to sensitive active substances but also to the preparation (pharmacological procedure), which is intended not to change with respect to viscosity and phases (emulsions, suspensions) under the effect of exposure to temperature.

SUMMARY OF THE INVENTION

It is therefore an object of the invention to provide a process of the type stated at the beginning in which the maintenance of a low filling material temperature is possible independently of the required operating temperature for sealing the capsules. This object is achieved according to the invention by a process which has the features in claim 1. It has surprisingly been found in this connection that, in spite of the confined spatial conditions in the filling wedge, high temperature differences can be maintained between the filling material and the material strips by a reduction in the heat transfer.

The heat transfer can in this case be reduced by a cooling medium, which is passed through at least one cooling channel between the feed channel in the filling wedge and the wedge surface. This may be a liquid cooling medium or a gaseous cooling medium. It goes without saying that it would also be conceivable for the cooling channel to extend concentrically around each individual feed channel, to ensure the most intensive heat dissipation possible.

The cooling medium may circulate in a cooling cycle and, after flowing through the cooling channel, be cooled down again in a heat exchanger. Alternatively, however, a constantly renewed cooling medium, such as for example tap water or ambient air, may also be passed through the cooling cycle.

The heating of the regions of the filling wedge facing the wedge surface may be performed by different heating devices. If the heating is performed with a liquid heating medium, coupling with the cooling cycle would even be conceivable, in that the heated-up cooling liquid is first fed entirely or partly to the heating cycle, before cooling down takes place at the heat exchanger.

In the case of extruded material strips of a starch composition, it has proven to be particularly advantageous if the region of the filling wedge facing the feed channel is kept at an operating temperature of less than 50° C. and if, furthermore, the temperature difference between the region of the filling wedge facing the feed channel and the region of the filling wedge facing the wedge surface is at least 10° C.

The invention also relates to a filling wedge for a machine for manufacturing capsules, in particular soft capsules, which has the features on claim 9. With a filling wedge of this type, the process described at the beginning can be carried out particularly easily. The means reducing the heat transfer in the filling wedge may be a heat-insulating layer. However, a thermal separation at the filling wedge can also be achieved by at least one hollow heat-insulating space. The hollow space may in this case be formed as a cooling channel which is connected to a coolant source. The hollow space may in this case be a component part of a cooling cycle, the dissipated heat repeatedly being given off to a heat exchanger.

Either a liquid or a gaseous coolant may be passed through the cooling channel. Depending on the flow rate and choice of coolant, quite different temperature segments can be covered. Conceivable coolants would be, for example, oil, water, glycols or nitrogen.

The hollow heat-insulating space could be evacuated to reduce the thermal conductivity, but also before use, or it could be filled with special gases to improve the insulating effect.

The hollow space advantageously extends two-dimensionally over the full width of the filling wedge. An interconnected system of channels would also be conceivable, however, to achieve the most optimum possible restricted guidance of the coolant.

It has also proven to be particularly advantageous if, along with a hollow space connected to a coolant source, there is arranged at least one further passive hollow space. This additional hollow or free space forms a further separation between the heated wedge surface and the cool center. The mass of the filling wedge is thereby restricted to the wall thickness that is absolutely necessary. In order to ensure adequate mechanical strength and uniform geometry of the filling wedge in spite of these hollow spaces, the filling wedge may be bolted on the side facing away from the wedge tip to a solid cover plate.

It has also proven to be very advantageous if the heating device is placed as far away as possible from the feed channels and as close as possible to the wedge surface. This is possible particularly advantageously with a two-dimensional, electrical resistance heater which extends directly in or under the wedge surface. The principle of such a heater corresponds approximately to that of the rear windshield heater in cars. The heating wires or heating strips can be laid directly under the non-stick Teflon layer of the wedge surface.

The arrangement at the filling wedge of at least one temperature sensor, by means of which the heating output of the heating device and/or the cooling output of the cooling device can be regulated, is also advantageous.

BRIEF DESCRIPTION OF THE DRAWINGS

Exemplary embodiments of the invention are described in more detail below and represented in the drawings, in which.

DETAILED DESCRIPTION OF PREFERRED EMBODIMENTS

Figure 1:
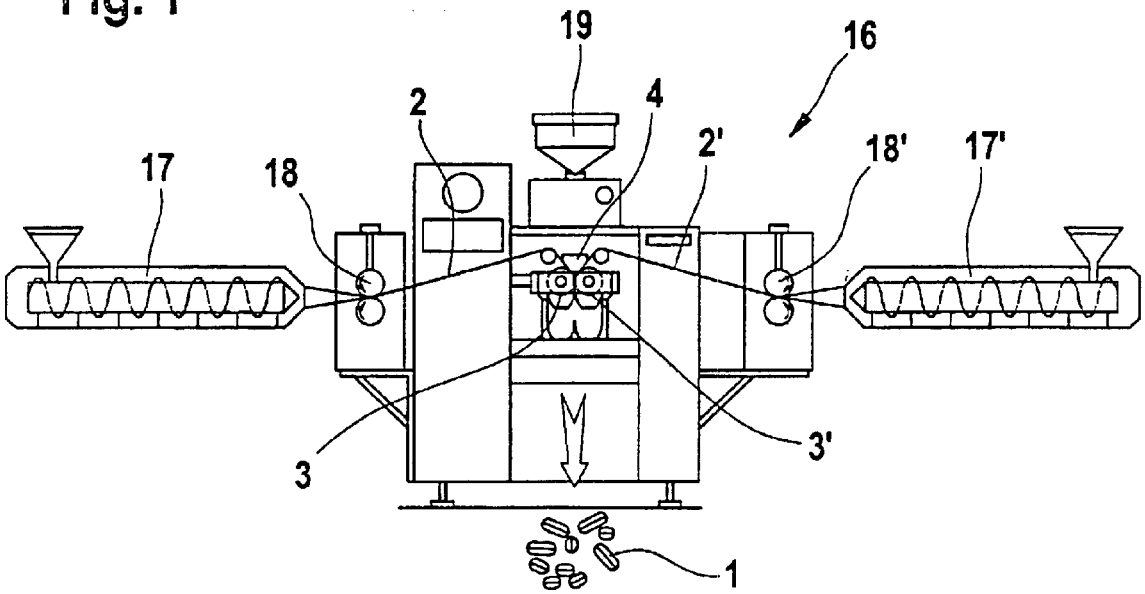
FIG. 1 shows a schematic representation of a rotary die machine.

FIG. 1 shows a rotary die machine 16, as used for processing two endless material strips 2, 2' of thermoplastic starch. The material strips are in this case extruded at the extruders 17, 17' from slot dies and drawn off by a respective pair of rolls 18, 18', and rolled to the correct thickness. Liquid, pasty or else, in certain cases, powdered filling material is introduced between the material strips from a filling material tank 19 via a filling wedge 4 and said strips are formed into capsules 1 at the forming rolls 3, 3'.

Figure 2:
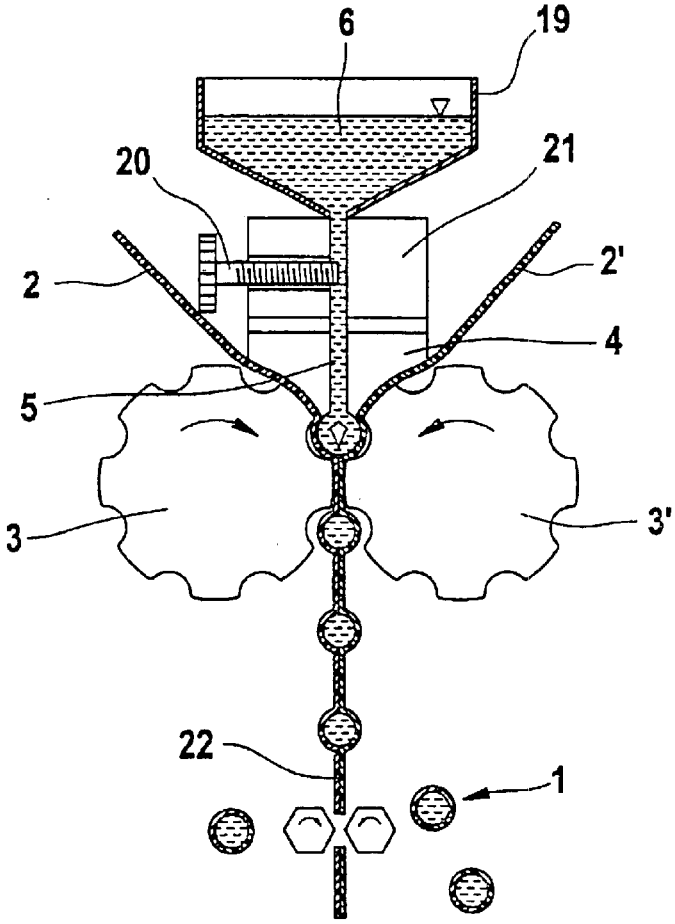
FIG. 2 shows a schematic representation of a filling wedge on a rotary die machine.

The encapsulating operation, known per se, is represented in slightly more detail in FIG. 2. The two counter-rotating forming rolls 3, 3' bond the material strips 2, 2', which have been brought to melting temperature, to form seamless capsules 1, these at the same time being detached from the remaining material strip or net 22. The filling wedge 4 with the feed channel 5 is arranged in the interstice of the two forming rolls and reaches into the closing capsules. The filling material 6 in the filling material tank 19 is fed in via a metering pump 21, it being possible for the amount to be set at a metering valve 20.

If the filling material is a powdered substance, a special feeding mechanism, as described for example in JP-A-10-211257, takes the place of the metering pump. It goes without saying that it is also possible to manufacture multi-part capsules from more than two material strips, it being possible for the individual chambers of the capsules to be filled with different filling material. Such a manufacturing process is described, for example, in WO 00/28976.

Figure 3:
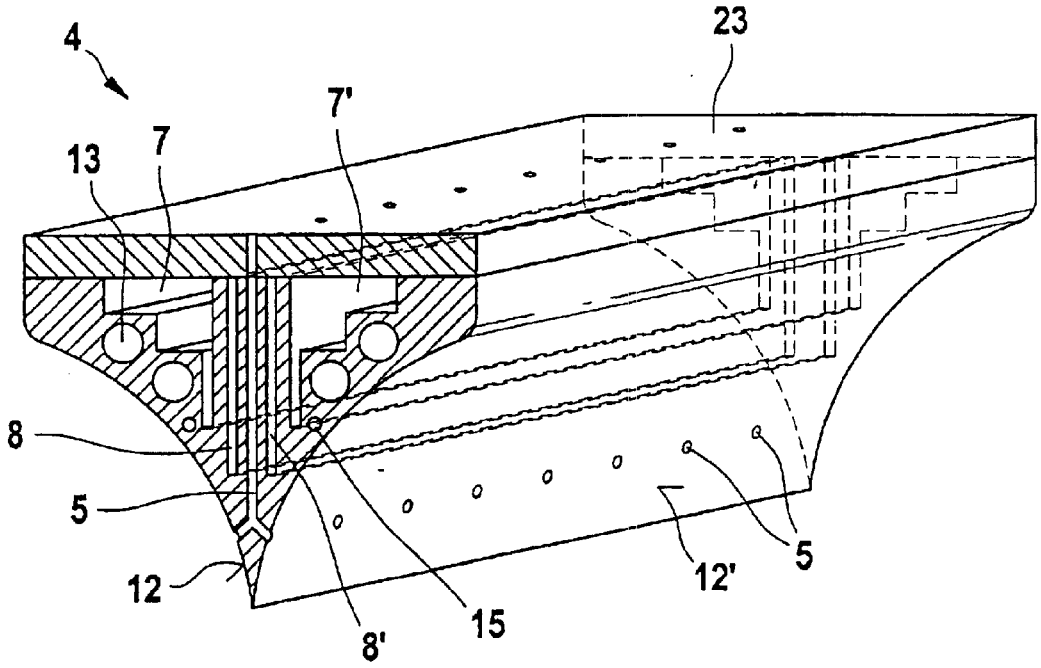
FIG. 3 shows a perspective representation of a sectioned first exemplary embodiment of a filling wedge.

The filling wedge 4 according to FIG. 3 has concave wedge surfaces 12, 12', adapted to the outer casing of the forming rolls. These surfaces are preferably provided with a Teflon coating. A plurality of feed channels 5 extend toward the tip of the filling wedge. Arranged between these filling channels and the wedge surfaces on each of the two sides is a two-dimensional cooling channel 8, 8'. Arranged near the wedge surfaces are bores, which extend over the entire width of the filling wedge and can be filled with heating cartridges 13. Temperature sensors 15 are likewise arranged in the region of the wedge surfaces.

The feed channels 5 are additionally separated from the heating cartridges 13 by step-like hollow spaces 7, 7'. To ensure mechanical stability, a cover plate 33 is bolted onto the filling wedge. This cover plate at the same time forms the upper termination of the cooling channels 8, 8' and of the hollow spaces 7, 7', but contains bores which expose the feed channels 5.

The cooling channels 8, 8' can be flowed through by a liquid coolant. The hollow spaces 7, 7' form a natural barrier for the heat transfer, although it goes without saying that it would be conceivable also to transport heat away via the hollow spaces, for example by blowing ambient air in with a fan. With the aid of these means reducing the heat transfer, it is obviously possible to maintain a relatively high temperature difference between the wedge surfaces 12, 12' and the feed channels 5, and consequently also to process temperature-sensitive filling materials. The temperature difference between the filling material (25° C.) and the wedge surface (80° C.) may consequently be >50° C.

Figure 4:
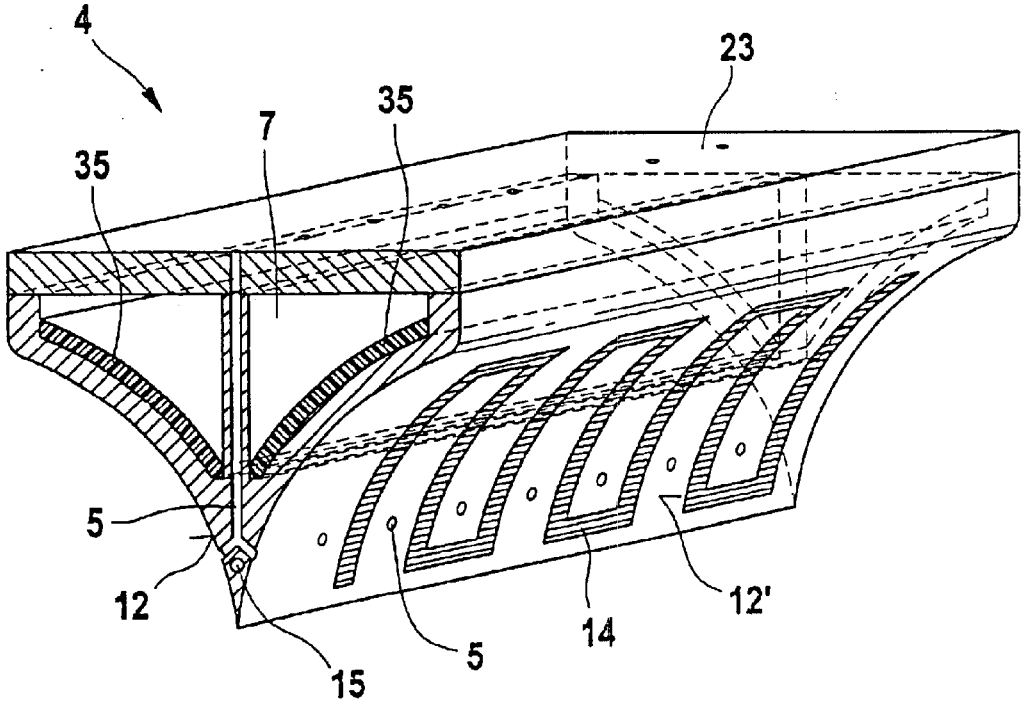
FIG. 4 shows a perspective representation of a sectioned second exemplary embodiment of a filling wedge.

The filling wedge according to FIG. 4 is of a similar construction to that in the exemplary embodiment according to FIG. 3. However, the heating of the wedge surfaces 12, 12' is not performed by means of heating cartridges, but by means of a two-dimensional resistance heater 14, which is arranged directly at the wedge surface. This may comprise heating strips which are arranged in a meandering form and can be applied in a suitable way. This measure has the effect that the heating source is still further away from the feed channels 5 and the heat of the heating device is given off directly where it is needed, that is at the wedge surfaces 12, 12'. Eliminating the heating cartridges allows the cross-sectional form of the filling wedge to be differently shaped and it is possible in particular to make the hollow space 7 much larger. In the case of the exemplary embodiment represented, no additional cooling channel is provided any longer and the cooling takes place exclusively by means of the hollow space 7. An insulation layer 35 may also be additionally applied on the inner wall of the wedge. Alternatively, the filling wedge can also be of a solid form, in which case a labyrinth of coolant bores would take the place of the hollow space 7. In the case of the exemplary embodiment according to FIG. 4, moreover, the temperature sensor 15 is placed directly in the wedge tip.

Figure 5:
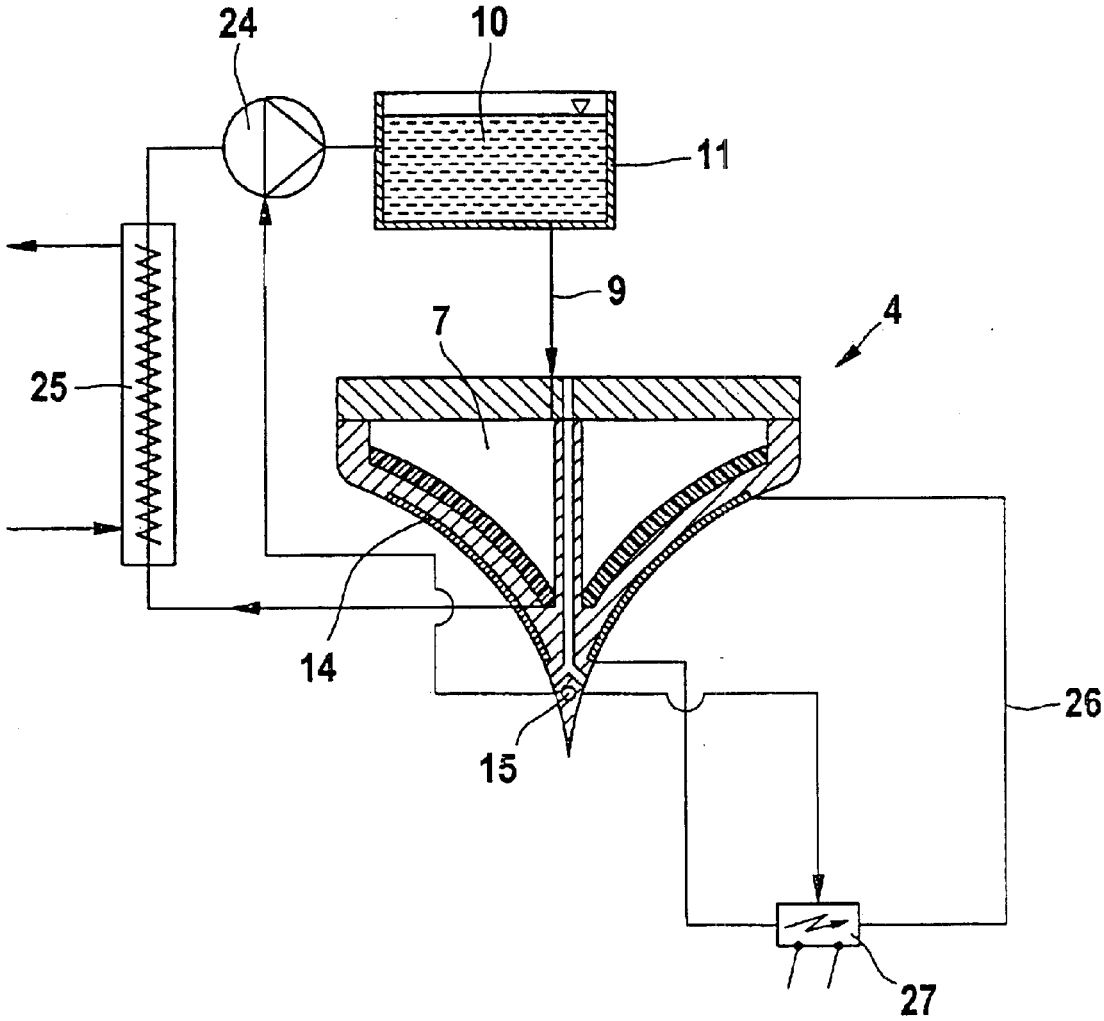
FIG. 5 shows a schematic representation of a sectioned filling wedge with a cooling cycle and heating device.

FIG. 5 schematically shows the interaction of the filling wedge 4 with the means for heating or cooling. The hollow cooling space 7 is integrated into a cooling cycle 9, which is supplied with coolant 10 from a coolant source 11. The circulation takes place by means of a coolant pump 24. For re-cooling the heated-up coolant, a heat exchanger 25 is provided. The coolant pump 24 can be actuated by means of the temperature sensors 15 arranged in the filling wedge.

The electrical resistance heaters 14 on the wedge surfaces are connected to a circuit 26, which is supplied with electrical energy by means of a transformer 27. The power supply can likewise be regulated or controlled by means of the temperature sensors 15.

Figure 6:
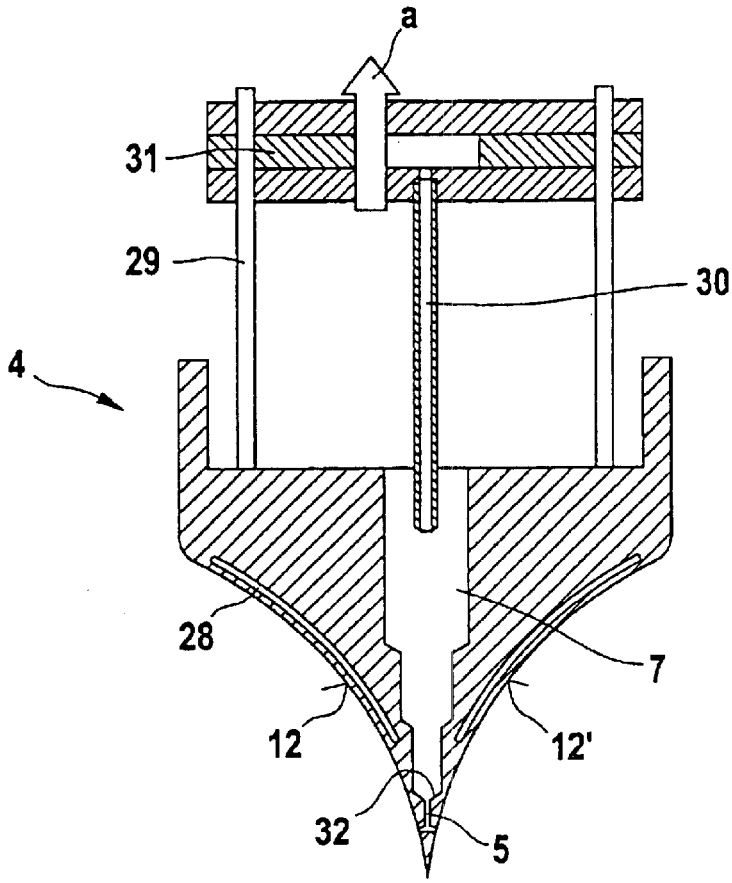
FIG. 6 shows a cross section through a third exemplary embodiment of a filling wedge with the cover plate raised.
Figure 7:
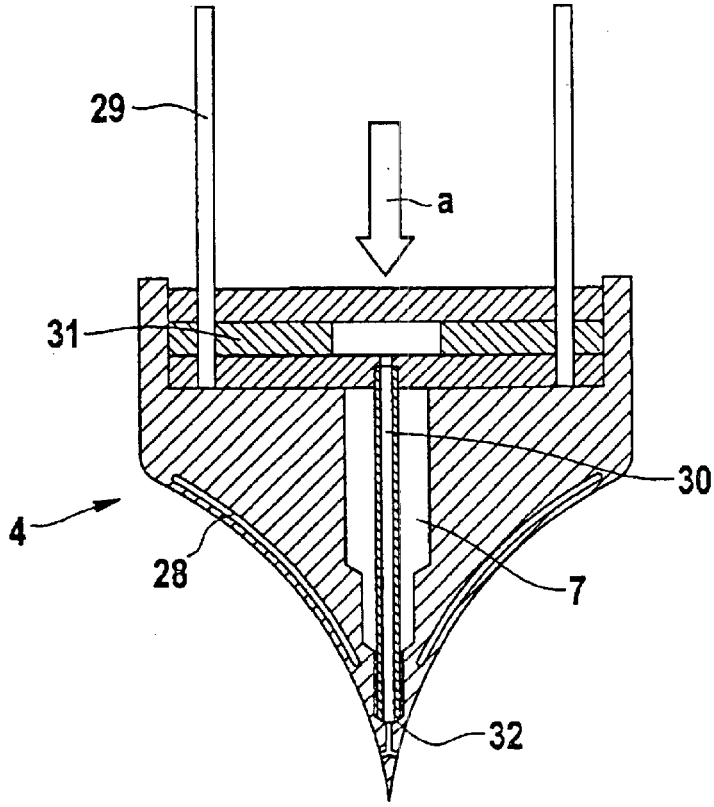
FIG. 7 shows the filling wedge according to FIG. 6 with the closure plate lowered.

In the case of the exemplary embodiment according to FIGS. 6 and 7, the closure plate 31 is formed as a slide, which can be raised and lowered in the direction of the arrow a on the vertical guides 29. Arranged on the slide are individual injection tubes 30, via which the feeding in of the filling material takes place. Each injection tube is provided at its end with a conical sealing seat, which interacts with a corresponding seat 32 on the inner side of the filling wedge. From there, a relatively short feed channel 25 on both sides leads to the wedge surfaces 12, 12'. A sealed connection is ensured by slight prestressing of the injection tubes 30 against the conical valve seat.

A gaseous cooling medium can be admitted to the hollow space 7 surrounding the injection tubes 30. Arranged directly under the wedge surfaces 12, 12' are eroded hollow spaces 28, which can receive a flexible resistance heating element. It goes without saying that additional bores for a liquid coolant can also be arranged in the filling wedge.

In the operating position according to FIG. 7, the slide 31 has been lowered, whereby the hollow cooling space 7 is closed off. The connection to the feed channel 5 has also been established. When the machine is stopped, the slide is immediately raised according to FIG. 6, whereby thermal decoupling also takes place between the parts carrying the filling material and the heated remainder of the filling wedge. As a result, the filling material at rest in the feed lines is not unnecessarily heated.

Figure 8:
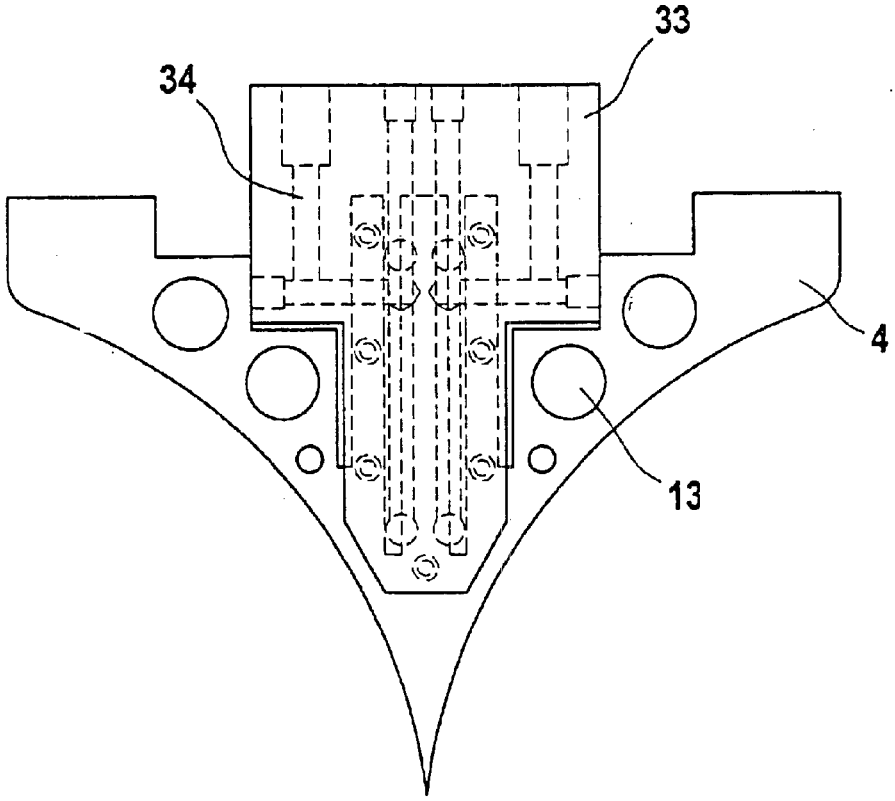
FIG. 8 shows a side view of the filling wedge according to FIG. 3 with the connection plate for coolant.
Figure 9:
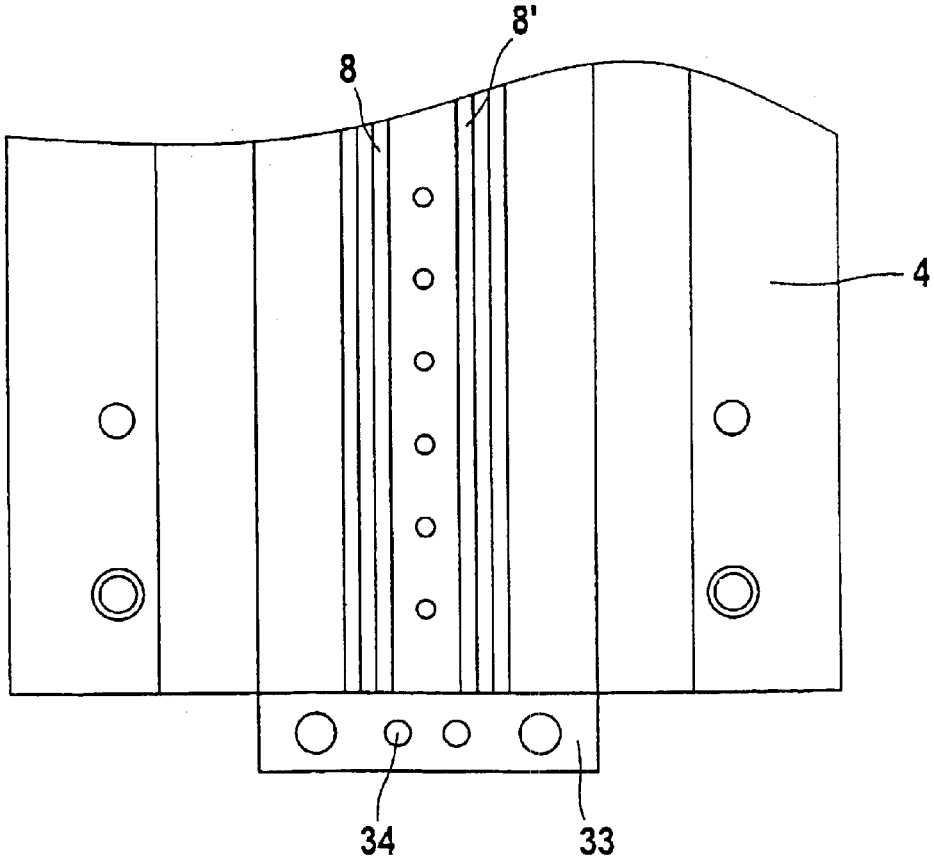
FIG. 9 shows a plan view of the filling wedge according to FIG. 8.

FIGS. 8 and 9 show a possible way in which liquid coolant can reach the narrow well-like cooling channels 8, 8' via a laterally arranged connection plate 33. The connection plate 33 is bolted laterally onto the filling wedge 4 by suitable fastening means. A system of cooling bores 34 establishes the connection with the laterally exposed cooling channels 8, 8'. The cooling channels are sealed off in the upward direction by the cover plate (not represented here). Such distributing plates may be arranged on both end faces of the filling wedge.

What is claimed is:

1. A rotary die process for manufacturing capsules (1), in particular soft capsules, in which at least two material strips (2, 2') are brought together by means of counter-running forming rolls (3, 3') and formed into capsules, a filling material (6) being introduced via a filling wedge (4), which is arranged in the drawing-in region of the forming rolls, through at least one feed channel (5) between the material strips closing to form capsules, wherein between the feed channel (5) and at least one wedge surface (12, 12') facing the material strip, the heat transfer is reduced by a cooling medium (10), which is passed through at least one cooling channel (8) between the feed channel (5) and the wedge surface.

2. The process as claimed in claim 1, wherein the cooling medium (10) is circulated in a cooling cycle (9) and, after flowing through the cooling channel (8), is cooled down again in a heat exchanger (25).

3. The process as claimed in claim 1, wherein the region of the filling wedge (4) facing the wedge surface (12, 12') is heated by means of a heating device (13, 14).

4. The process as claimed in claim 1, wherein the region of the filling wedge (4) facing the feed channel (5) is kept at an operating temperature of less than 50° C.

5. The process as claimed in claim 1, wherein the temperature difference between the region of the filling wedge facing the wedge surface is at least 10° C.

6. The process as claimed in claim 1, wherein the material strips (2, 2') consist of a composition containing starch and in that they are formed by extension before being drawn between the forming rolls (3, 3').

7. The process as claimed in claim 6, wherein the melting temperature for bonding the two material webs between the form rollers is at least 50° C.

8. A filling wedge (4) for a machine (16) for manufacturing capsules, in particular soft capsules, by the rotary die process with two preferably concave wedge surfaces (12, 12') and with at least one feed channel (5), running between the wedge surfaces, for discharging filling material (6), wherein a means reducing the heat transfer is arranged between the feed channel (5) and at least one wedge surface (12, 12'), said means being a cooling channel which is connected to a coolant source.

9. The filling wedge as claimed in claim 8, wherein the cooling channel is a component part of a cooling cycle (9) with at least one heat exchanger (25).

10. The filling wedge as claimed in claim 8, wherein along with a cooling channel connected to a coolant source, there is arranged at least one hollow space (7) acting as a further means reducing the heat transfer.

11. The filling wedge as claimed in claim 10, wherein a layer of heat-insulating material is applied on the surface of the hollow space.

12. The filling wedge as claimed in claim 10, wherein the hollow space extends two-dimensionally over the width of the filling wedge.

13. The filling wedge as claimed in claim 8, wherein a heating device (13, 14) is arranged between the cooling channel and the wedge surface (12, 12').

14. The filling wedge as claimed in claim 13, wherein the heating device is at least one heating cartridge (13) arranged in a bore.

15. The filling wedge as claimed in claim 13, wherein the heating device is at least one two-dimensional, electrical resistance heater which extends directly in or under the wedge surface (12, 12').

16. The filling wedge as claimed in claim 13, wherein at least one temperature sensor (15), by means of which the heating output of the heating device and/or the cooling output of a cooling device can be regulated, is arranged at the filling wedge.

17. A machine (16) for manufacturing capsules, in particular soft capsules, by the rotary die process with at least one filling wedge (4) as claimed in claim 8 and with at least two counter-rotatable forming rolls for bringing together at least two material strips (2, 2') and forming them into capsules.

* * * * *